United States Patent [19]

Reed

[11] Patent Number: 4,676,578

[45] Date of Patent: Jun. 30, 1987

[54] ELECTRICAL INTERCONNECTION ASSEMBLY

[75] Inventor: Elmer E. Reed, Palos Verdes Peninsula, Calif.

[73] Assignee: Hughes Aircraft Company, Los Angeles, Calif.

[21] Appl. No.: 721,098

[22] Filed: Apr. 8, 1985

[51] Int. Cl.[4] ..... H01R 9/16

[52] U.S. Cl. ..... 439/465; 439/718

[58] Field of Search ..... 339/198 R, 198 G, 198 GA, 339/198 J, 198 H, 198 P, 198 E, 176 M, 218 R, 218 M, 277 R, 107, 103 R, 103 M, 206 R, 206 P, 18 R, 18 C, 18 P

[56] References Cited

U.S. PATENT DOCUMENTS

| | | | |
|---|---|---|---|
| 3,016,512 | 1/1962 | Borchard | 339/277 |
| 3,753,216 | 8/1973 | Johnson et al. | 339/198 GA |
| 4,284,316 | 8/1981 | Debaigt | 339/198 J |
| 4,410,224 | 10/1983 | Giulie | 339/18 R |
| 4,449,777 | 5/1984 | Baribeau | 339/99 R |

*Primary Examiner*—John McQuade
*Assistant Examiner*—Thomas M. Kline
*Attorney, Agent, or Firm*—Paul M. Coble; Terje Gudmestad; Anthony W. Karambelas

[57] ABSTRACT

An electrical interconnection assembly is disclosed for use with high voltage devices such as traveling-wave tubes. The assembly includes an electrically insulating housing having a plurality of recesses formed in its outer and inner surfaces. Leads from the high voltage device can be connected directly to respective conductive pins mounted in recesses in the housing inner surface, and electrical conductors from a power supply can be connected directly to respective conductive pins mounted in recesses in the outer surface of the housing and which are electrically connected to respective conductive pins on the inner surface. Protruding staggered gripping elements on the housing outer surface and on a removable cover plate for the housing minimize the possibility of separation of electrical conductors from the conductive pins.

7 Claims, 9 Drawing Figures

ELECTRICAL INTERCONNECTION ASSEMBLY

The Government has rights in this invention pursuant to Contract No. F08635-82-C-002 awarded by the United States Air Force.

BACKGROUND OF THE INVENTION

1. Field of the Invention

This invention relates to electrical interconnection, and more particularly relates to a high voltage interconnection assembly especially suitable for applying large operating voltages to traveling-wave tubes and similar electrical utilization devices.

2. Description of Related Art

Traveling-wave tubes generally operate at high voltage levels, such as five kilovolts and greater, and it is necessary to connect such tubes to a high voltage source of power, often in field environments. A problem encountered with many conventional interconnect assemblies used for connecting a high voltage power supply to a traveling-wave tube is the fact that leads frequently are broken during packaging or field assembly. When the leads are broken in a field environment, it is virtually impossible to repair them without returning the interconnect assembly to the factory. Furthermore, due to the labor time involved, repair at a factory location usually is not economically justified; thus, the interconnect assembly frequently is discarded.

A few high voltage interconnects are available which do not use leads. However, the manufacturing cost, and hence the purchase price, of these interconnects is relatively large.

In several conventional high voltage interconnect assemblies designed to deliver voltage in a range of, for example, five to eleven kilovolts, arcing may result due to insufficient spacing or insulation between contacts. Once arcing starts, an "arc track" effect may ultimately destroy the interconnect assembly, if not the traveling-wave tube itself. Furthermore, since many such interconnect assemblies are used in airborne environments, weight and size are critical.

Presently available high voltage interconnect assemblies with "flying leads" cannot be attached conveniently and quickly in a field environment without any strain-induced tendency for inadvertent separation of such leads from a terminal contact.

SUMMARY OF THE INVENTION

It is, therefore, an object of the invention to provide an electrical interconnection assembly for connecting a traveling-wave tube to a high voltage power supply in a convenient and low cost manner.

It is a further object of the invention to provide a high voltage electrical interconnection assembly including a unique connector system capable of rapidly and efficiently interconnecting a number of electrical conductors.

It is still another object of the invention to provide an electrical interconnection assembly in which the electrical conductors are connected in a manner minimizing inadvertent separation of conductive connections.

An electrical interconnection assembly according to the invention includes an electrically insulating housing member having an outer surface and an inner surface and adapted for mounting on an electrical utilization device. Recesses in the outer surface receive a plurality of first electrical conductors from a power supply and are provided with a plurality of first connectors for electrically engaging respective first electrical conductors. Recesses in the inner surface receive a plurality of second electrical conductors from the electrical utilization device and are provided with a plurality of second connectors for electrically engaging respective second electrical conductors. Each second connector is electrically connected to a respective first connector. First and second electrically insulating covers are adapted to be releasably secured to the housing member to cover respective portions of the outer and inner housing member surfaces including the recesses therein.

Additional objects, advantages, and characteristic features of the present invention will become readily apparent from the following detailed description of a preferred embodiment of the invention when considered in conjunction with the accompanying drawings.

DETAILED DESCRIPTION OF THE INVENTION

Figure 1:
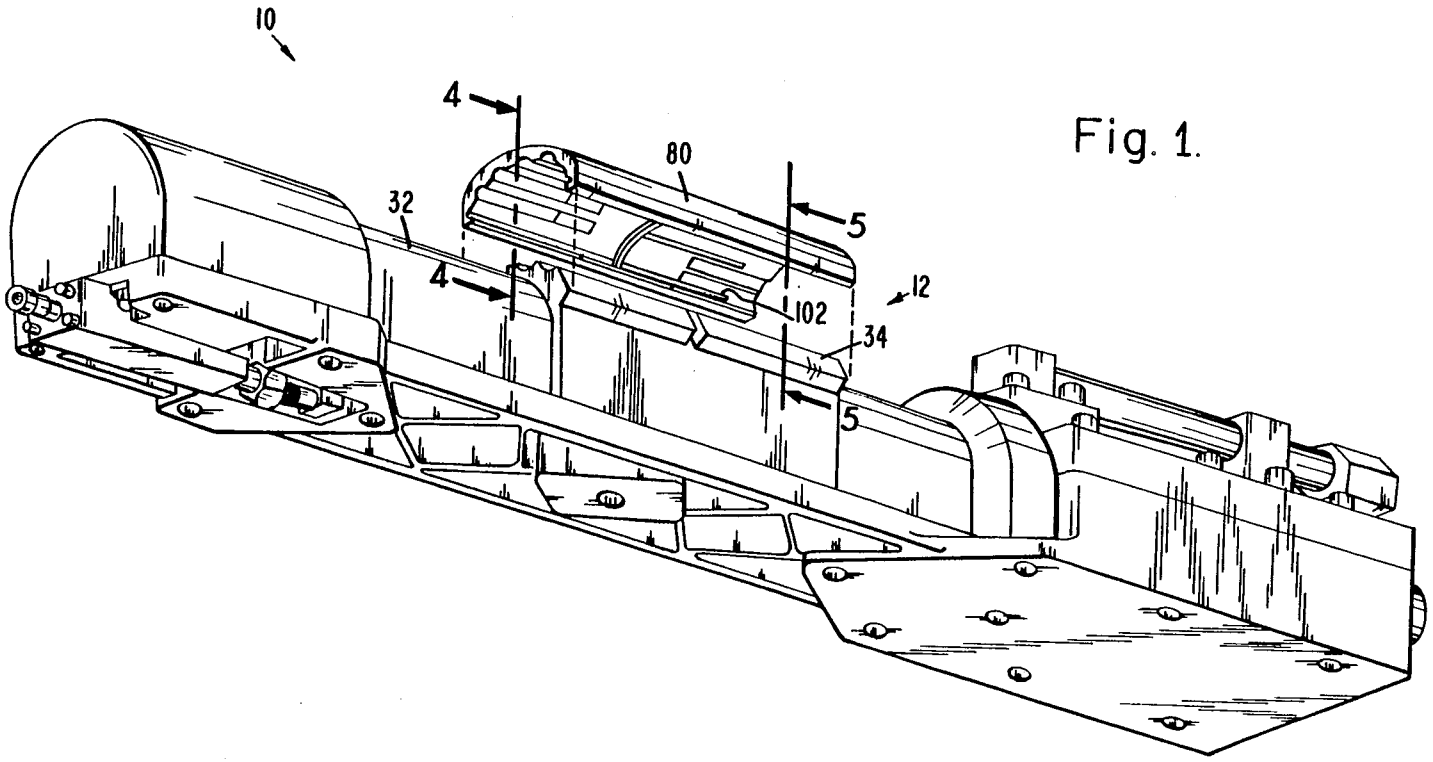
FIG. 1 is an exploded perspective view showing an electrical interconnection assembly according to the invention used in conjunction with a traveling-wave tube.
Figure 6:
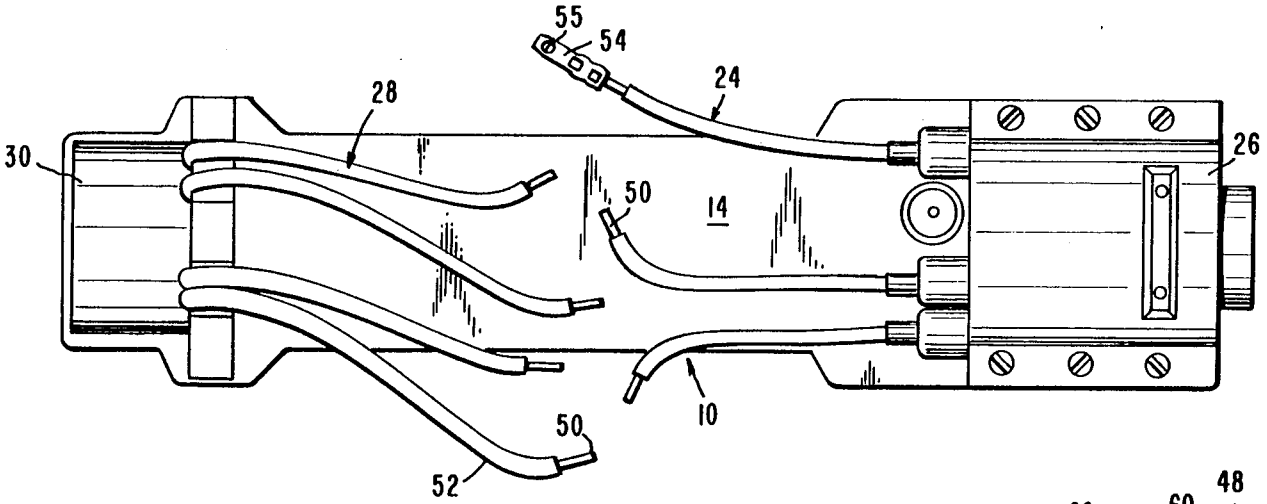
FIG. 6 is a top plan view of the assembly of FIG. 1 with the housing member removed.

Referring to the drawings in more detail, FIG. 1 illustrates a traveling-wave tube 10 provided with an electrical interconnection assembly 12 according to the invention. As shown in FIG. 6, a plurality of first inner electrical conductors 24 (three are shown) are designed to deliver relatively low voltages to a terminal block 26 at one end of the traveling-wave tube 10. These voltages typically may be about 5,000 volts, 7,000 volts, and 9,000 volts, for example. A plurality of second inner electrical conductors 28 (four are shown) are connected to a terminal block 30 at the opposite end of the traveling-wave tube 10. The conductors 28 are designed to deliver a higher voltage, for example, 11,000 volts, to the tube 10.

Figure 2:
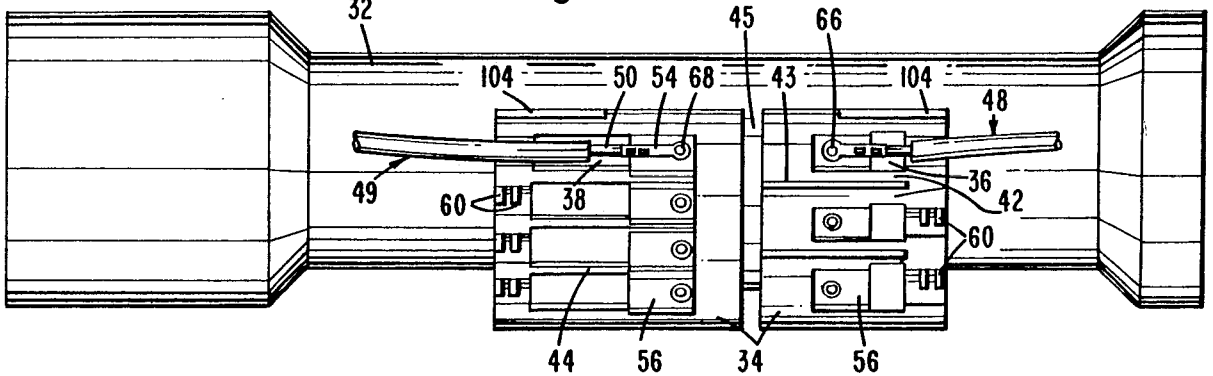
FIG. 2 is a top plan view of the housing member of FIG. 1.
Figure 3:
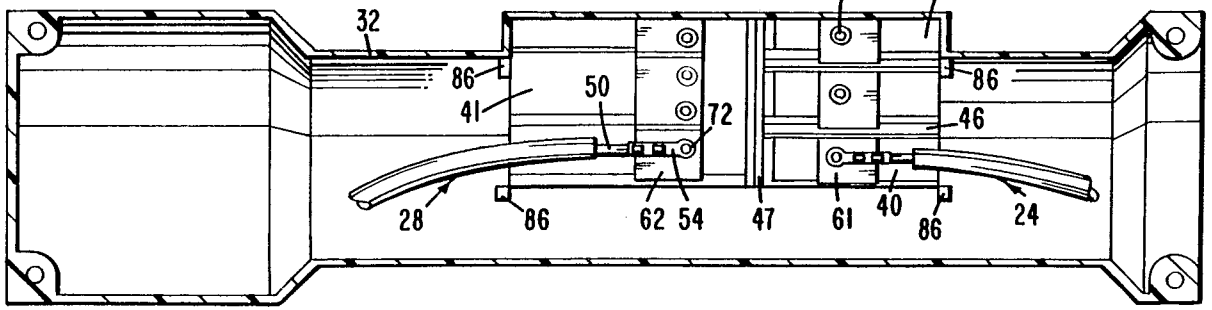
FIG. 3 is a bottom view of the housing member of FIG. 1.

As shown in FIGS. 1 through 6, the interconnection assembly 12 comprises a housing member 32 of an inverted substantially U-shaped cross-section and sized to extend over the outer envelope of the magnetic focusing arrangement 14 of the traveling-wave tube 10. Housing member 32 may be of a plastic material such as glass-filled polypropylene. As a specific example for illustrative purposes, the material for the housing member 32 may be approximately 10% glass and approximately 90% polypropylene. Integrally formed with the housing member 32 on an upper surface thereof is a conductor mounting platform 34. The interior surface of the housing member 32 is integrally provided with a conductor mounting cavity 35 (FIG. 3). The mounting platform 34 is provided with a first plurality (three are shown) of neighboring conductor-receiving recesses 36 designed to receive relatively low voltage outer conductors 48 (FIG. 2).

Another portion of the mounting platform 34 is provided with a second plurality (four are shown) of neighboring conductor-receiving recesses 38 to receive higher voltage outer conductors 49 (FIG. 2). The mounting cavity 35 on the inner surface of the housing member 32 is similarly provided with three recesses 40 substantially aligned with the recesses 36 and designed to receive the conductors 24. Similarly, another portion of inner surface of the housing member 32 is provided with an enlarged recessed area 41 for receiving the conductors 28. However, individual recesses could be formed, if desired, to receive each of the conductors 28.

Separating adjacent recesses 36 on the outer surface of the housing member 32 are a pair of parallel longitudinally extending ridges 42 having a longitudinally extending groove 43 therebetween and designed to prevent electrical arcing or corona discharge between the recesses 36. Disposed between adjacent recesses 38 are longitudinally extending ridges 44 likewise designed to prevent corona discharge or arcing. To preclude arcing between the low voltage and high voltage outer conductors 48 and 49, a transversely extending groove 45 is provided between the areas designed to receive these sets of conductors. Longitudinally extending ridges 46 are provided on the inner surface of the housing member 32 to preclude arcing between the inner conductors 24 in the respective recesses 40, while transversely extending ridge 47 is provided to preclude arcing between the inner conductors 28 and 24.

The inner electrical conductors 24 and 28 from the terminal blocks 26 and 30 of the traveling-wave tube 10 and outer electrical conductors 48 and 49 from an external power supply are all similar in construction. As shown in FIGS. 2, 3 and 6, each conductor 24, 28, 48 and 49 comprises an inner electrical wire 50 surrounded by an outer insulating layer or "sheath" 52. The end portions of the conductors 24, 28, 48 and 49 are stripped, i.e., the insulating layer 52 is removed to expose the wire 50. As shown in FIG. 6, an electrically conductive terminal connector 54 having a pin-receiving hole 55 at one end may be crimped onto or otherwise secured to the exposed end of the wire 50. The terminal connector 54 may be of gold-plated, heat-treated beryllium-copper, for example, although some nickel may be included to prevent copper oxide from migrating from the connector 54 through the gold. Each of the recesses 36 and 38 have elevated head portions 56 at their inner ends for receiving the terminal connectors 54, and have sections of greater depth throughout the remainder of their length to receive the insulated portions 52 of the conductors 48 and 49. Each of the recesses 36 and 38 further define near their outer ends a pair of transversely disposed protruding bar portions 60. The protruding bar portions 60 are designed to engage the insulating portion 52 of conductor 48 or 49 and minimize any tendency for inadvertent pulling of a conductor 48 or 49 out of its associated recess or inadvertent separation of the terminal connectors 54 from the wires 50.

The various recesses 40 and the enlarged recessed area 41 on the inner surface of the housing member 32 are similarly provided with elevated head portions 61 and 62, respectively, to receive terminal connectors 54 mounted on stripped ends of the electrical conductors 24 and 28 as described above with respect to conductors 48 and 49. Conductive pins 66 and 68 protrude from the head portions 56 of each of the recesses 36 and 38, respectively, while similar conductive pins 70 and 72 protrude from the respective head portions 61 and 62 of the recesses 40 and 41, respectively. The pins 66, 68, 70 and 72 may be gold-plated brass, for example.

Figure 9:
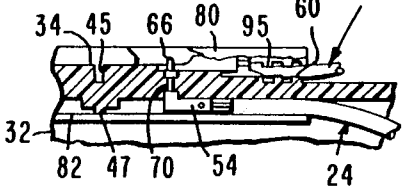
FIG. 9 is an enlarged sectional view of a portion of the housing member showing how interconnection between an outer conductor and an inner conductor may be achieved.

It should be understood that the conductive pins 66 and 70 may be integral with each other (as shown in FIG. 9) and extend through an aperture in the housing 32. Similarly conductive pins 68 and 72 may be integrally formed with one another. In any event, the pins 68 and 72 are electrically connected together, while the pins 66 and 70 are likewise electrically interconnected. All of the pins 66, 68, 70 and 72 are designed to snuggly but removably fit in the holes 55 in the terminal connectors 54.

Figure 7:
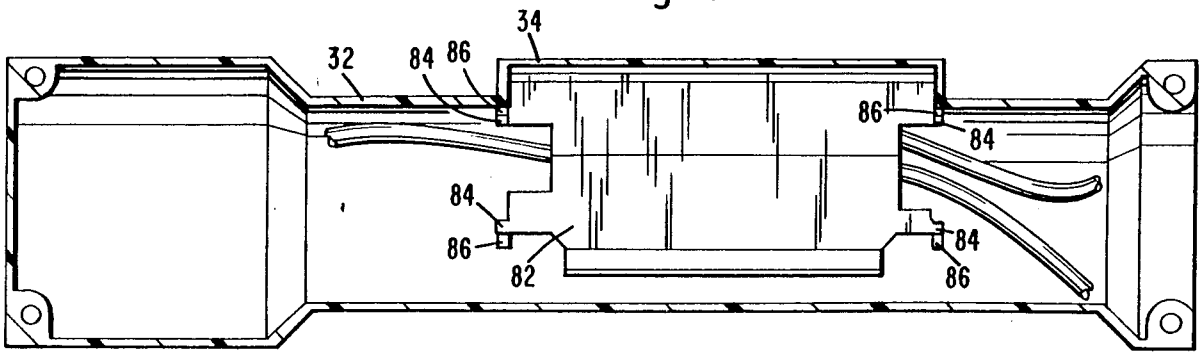
FIG. 7 is a bottom view of the housing member with the inner cover in place.

An electrical interconnection assembly according to the invention includes an outer cover 80 (FIG. 1) and inner cover 82 (FIG. 7), both of a flexible insulating material such as plastic. As a specific example for illustrative purposes, the covers 80 and 82 may be of a glass-filled polypropylene consisting of approximately 20% glass and approximately 80% polypropylene. The inner cover 82 has a bent cross-section substantially conforming to the curvature of the inner surface of the housing member 32. The cover 82 is integrally formed with a pair of longitudinally projecting tabs 84 on each of its opposite ends. The tabs 84 are adapted to be engaged by abutments 86 integrally formed on the inner surface of the housing member 32. The cover 82 can be bent slightly about its longitudinal axis and snap-fit into engaging relationship between the tabs 84 and the abutments 86. The inner cover 82 can be removed from this engaging relationship simply by prying it to move the tabs 84 out of engagement with the abutments 86. It is further pointed out that the cover 82 is shaped to contact the ends of the pins 70 and 72. Thus, when terminal connectors 54 are mounted in their desired engaging relationship with the pins 70 and 72, the cover 82 will help retain these terminal connectors 54 in place.

Figure 8:
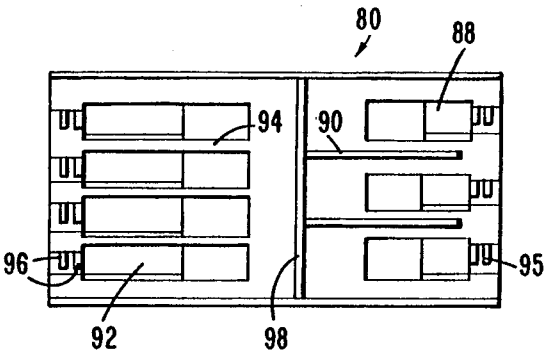
FIG. 8 is a bottom view of the outer cover.
Figure 5:
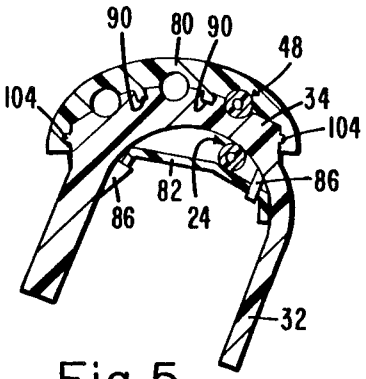
FIG. 5 is a similar vertical sectional view taken along line 5—5 of FIG. 1.
Figure 4:
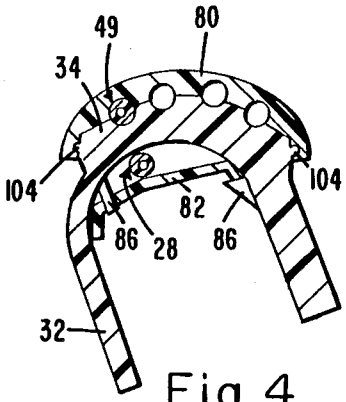
FIG. 4 is a vertical sectional view taken along line 4—4 of FIG. 1 with outer and inner covers in secured positions.

The outer cover 80 is substantially arcuately shaped, as shown in FIGS. 4 and 5, and defines on its inner surface three longitudinal recesses 88 (FIG. 8) which conform to and are disposed in registration with the recesses 36 in the mounting platform 34 when the cover 80 is snap-fit into position. In addition, longitudinal ridges 90 are integrally provided on the inner surface of the cover 80 and are adapted to fit in the respective grooves 43 in the platform 34. Similarly, another region of the inner surface of the cover 80 is provided with four recesses 92 capable of being disposed in registration with the recesses 38 in the platform 34.

Each of the recesses 92 are separated by ridges 94 which are aligned with the respective ridges 44 between the recesses 38 when the cover 80 is in place. The recesses 88 each define near their outer ends a pair of transversely disposed protruding bar portions 95 which are staggered along the length of the recesses 88 and 36 with respect to the bar portions 60 and cooperate therewith to grip the conductors 48 therebetween (FIG. 9). Similarly, the outer ends of the recesses 92 are provided with a pair of staggered transverse protruding bar portions 96 which cooperate with the opposing bar portions 60 to grip the conductors 49 therebetween.

The cover 80 is also provided with a transversely extending ridge 98 which is capable of fitting into transverse groove 45 in the platform 34. The ridge 98 aids in preventing arcing between the high and low voltage outer conductors residing in the recesses 92 and 88, respectively. The cover 80 further defines a pair of longitudinally extending grooves 102 near the respective transverse extremities of its inner surface. The grooves 102 are capable of engaging outwardly extending projections 104 on the mounting platform 34. In this way, the cover 80 can be snap-fit into position over the platform 34 and removed therefrom by merely prying one of its edges from the engaging projections 104.

In use of the electrical interconnection assembly 12, conductors 24 and 28 from the traveling-wave tube 10 are electrically connected to the pins 70 and 72 by press-fitting the pins 66 and 68 into the connector holes 55. Individual conductors 48 and 49 from the power supply are similarly connected to the pins 66 and 68, respectively.

After the conductors 48 and 49 have been connected to the respective pins 66 and 68, the respective covers 82 and 80 can be snap-fit into place on the inner and outer surfaces of the housing member 32. As this occurs, the bar portions 95 and 96 on the outer cover 80 will cooperate with the bar portions 60 to hold the outer conductors 48 and 49 in place.

It may be seen that an electrical interconnection assembly according to the invention is designed to handle abuses that may be encountered in field operations and enables simple and reliable field replacement of th conductors 48 and 49. It is also designed to withstand relatively high and low service temperatures, as for example, from about −55° C. to about +100° C. Furthermore, the assembly is highly reliable at normal service temperatures of about 70° C.

Although the present invention has been shown and described with reference to a particular embodiment, nevertheless, various changes and modifications which are obvious to a person skilled in the art to which the invention pertains are deemed to lie within the spirit, scope, and contemplation of the invention.

What is claimed is:

1. An electrical interconnection assembly comprising:

an electrically insulating housing member having an outer and an inner surface and adapted for mounting on an electrical utilization device;

said outer surface defining a first plurality of adjacent elongated conductor-receiving recesses for receiving a plurality of first electrical conductors from a power supply, said recesses being provided with a first plurality of conductor pins, said first electrical conductors having electrically conductive terminal connectors with a pin-receiving hole therein for electrically engaging respective ones of said first conductor pins, each pair of adjacent first recesses being separated by a pair of longitudinally extending ridges having a longitudinally extending groove therebetween;

said inner surface defining a second plurality of adjacent conductor-receiving recesses for receiving a plurality of second electrical conductors from said electrical utilization device, said second conductor-receiving recesses being substantially aligned with respective ones of said first conductor recesses and being provided with a second plurality of conductor pins, said second electrical conductors having electrically conductive terminals with a pin-receiving hole therein for electrically engaging respective ones of said second conductor pins, each of said second conductor pins being electrically connected to a respective one of said first conductor pins, each pair of adjacent second recesses being separated by a longitudinally extending ridge;

first electrically insulating cover means for covering a portion of said outer surface including said first recesses, said first cover means including a plurality of longitudinal ridges on the inner surface thereof, said ridges being adapted to fit into respective ones of said longitudinally extending grooves in said outer surface;

means on said first cover means to releasably secure said first cover means to said housing member;

second electrically insulating cover means for covering a portion of said inner surface including said second recesses; and means on said second cover means to releasably secure said second cover means to said housing member.

2. An electrical interconnection assembly according to claim 1 wherein each of said first plurality of elongated recesses defines at least one transversely disposed protruding bar portion for securely contacting the electrical conductor therein.

3. An electrical interconnection assembly according to claim 2 wherein said first cover means defines a plurality of elongated recesses substantially aligned with respective ones of said recesses on said outer surface when said first cover means is secured to said housing member.

4. An electrical interconnection assembly according to claim 3 wherein each of said recesses on said first cover means defines at least one transversely disposed protruding bar portion offset with respect to a respective transversely disposed protruding bar portion on said outer surface when said first cover means is secured to said housing member.

5. An electrical interconnection assembly comprisng:

an electrically insulating housing member having an outer surface and an inner surface and adapted for mounting on an electrical utilization device;

said outer surface defining a first plurality of conductor-receiving recesses, each pair of adjacent first recesses being separated by a pair of longitudinally extending ridges having a longitudinally extending groove therebetween;

a plurality of first terminal connector pins, each pin being mounted on a respective one of said first conductor-receiving recesses in said outer surface, a like plurality of apertured connector terminals respectively connected to a plurality of first electrical conductors from a power supply and adapted to electrically engage respective ones of said first terminal connector pins;

said inner surface defining a second plurality of conductor-receiving recesses, each pair of adjacent second recesses being separated by a longitudinally extending ridge;

a plurality of second terminal connector pins, each pin being mounted on a respective one of said second conductor receiving recesses in said inner surface, a like plurality of apertured connector terminals respectively connected to a plurality of second electrical conductors from said electrical utilization device and being adapted to electrically engage respective ones of said second terminal connector pins, each of said second terminal connector pins being electrically connected to a respective one of said first terminal connector pins;

first retainer means adapted to be releasably attached to said housing member for covering a portion of said outer surface including said first terminal connector pins, said first retainer means including a plurality of longitudinal ridges on the inner surface thereof, said ridges being adapted to fit into respective ones of said longitudinally extending grooves in said outer surface; and second retainer means adapted to be releasably attached to said housing member for covering a portion of said inner surface including said second terminal connector pins.

6. An electrical interconnection assembly according to claim 5 wherein said first plurality of recesses are elongated recesses for receiving respective ones of said first electrical conductors, said first terminal connector pins being mounted in respective ones of said elongated recesses adjacent to one end thereof.

7. An electrical interconnection assembly according to claim 6 wherein each of said elongated recesses defines at least one transversely protruding bar portion adjacent to its end remote from said one end for securely contacting the electrical conductor therein.

* * * * *